US005393237A

United States Patent [19]

Roy et al.

[11] Patent Number: 5,393,237

[45] Date of Patent: Feb. 28, 1995

[54] ELECTRIC PLUG LOCKING DEVICE

[75] Inventors: William J. Roy, 2511 Ridge Brook Trail, Duluth, Ga. 30136; Michael C. Mayne, Conyers, Ga.

[73] Assignee: William J. Roy, Duluth, Ga.

[21] Appl. No.: 125,414

[22] Filed: Sep. 22, 1993

[51] Int. Cl.[6] ..... H01R 13/44

[52] U.S. Cl. ..... 439/134; 439/133

[58] Field of Search ..... 439/133, 134, 135, 136, 439/142, 367, 368, 369, 370

[56] References Cited

U.S. PATENT DOCUMENTS

| | | | |
|---|---|---|---|
| 2,538,296 | 1/1951 | Crocker | 439/131 |
| 2,643,787 | 6/1953 | Rockman | 220/3.2 |
| 3,926,494 | 12/1975 | Maillaro | 439/131 |
| 4,488,764 | 12/1984 | Pfenning et al. . | |
| 4,705,335 | 11/1987 | Goebel | 439/133 |
| 4,865,557 | 9/1989 | Kershaw | 439/133 |
| 4,997,381 | 3/1991 | Oh | 439/131 |
| 5,052,939 | 10/1991 | Koch | 439/133 |
| 5,061,194 | 10/1991 | Herman et al. | 439/133 |
| 5,082,450 | 1/1992 | Warren, Sr. et al. | 439/131 |
| 5,259,782 | 11/1993 | Giffin | 439/369 |

OTHER PUBLICATIONS

"Electrical Plug Lockouts", Champion America, Inc., Macedonia, Ohio.

*Primary Examiner*—Larry I. Schwartz
*Assistant Examiner*—Hien D. Vu
*Attorney, Agent, or Firm*—Kennedy & Kennedy

[57] ABSTRACT

An electric plug locking device (10), which remains affixed to an electric plug (13) for preventing unsupervised use of electrical equipment, has an upper housing member (11) movably mounted to a lower housing member (12). The upper housing member which has an opening (23) for receiving a plug terminal (15) moves from a position that shields the terminal to prevent it from being inserted into an electrical socket to a position that unshields the plug terminal to permit it to be inserted into the socket.

12 Claims, 2 Drawing Sheets

ELECTRIC PLUG LOCKING DEVICE

TECHNICAL FIELD

The present invention relates to child safety devices for preventing unsupervised use of electrical equipment and appliances. More particularly, the invention relates to an electric plug locking device affixable to an electrical plug.

BACKGROUND OF THE INVENTION

Various kinds of electric plug locking devices exist to prevent unsupervised use of electrical equipment and to appliances. Exemplary of such is the one disclosed in U.S. Pat. No. 4,488,764. This plug locking device entirely encloses an electrical plug, including its body and terminals, within a device cavity that has an opening through which an electrical cord extends. Access to the cavity is controlled by a cavity cover with a key lock. When the plug locking device is unlocked to allow use of the plug, the plug is completely removed.

Distinct disadvantages exist with this type of plug locking device. For example, a key must be readily available to unlock it. If the key is off the premises, delay occurs in accessing the plug. If the key is misplaced, a new key must be made. Once the device is unlocked, it too may be misplaced.

Another plug locking device, as disclosed in U.S. Pat. No. 4,865,557, eliminates the need for a key by permanently locking the plug into a chamber with a post and cap latch. However, the post must be severed to permit the device to open and release the plug. Such a plug locking device, therefore, can be used only once.

Thus, there exists a need for a plug locking device to secure an electrical plug from use which remains affixed to the plug even in an unlocked position, which does not necessarily require the use of a key, and which is capable of repeated use. Accordingly, it is to the provision of such an improved plug locking device that the present invention is primarily directed.

SUMMARY OF THE INVENTION

The present invention provides an electric plug locking device for preventing unsupervised use of electrical equipment that has a lower housing member, in which the plug may be seated, mounted to an upper housing member which has an opening for receiving therethrough a plug terminal. The upper housing member moves relative to the lower housing member between a position that shields the plug terminal to prevent it from being inserted into an electrical socket and a position that unshields the plug terminal to permit it to be inserted into the socket. The plug locking device has lock means for locking the upper housing member in its shielding position.

BRIEF DESCRIPTION OF THE DRAWINGS

FIG. 3A is a side view, in cross-section, of the plug locking device of FIG. 1 shown in an unlocked position, while

DETAILED DESCRIPTION OF THE INVENTION

Figure 1:
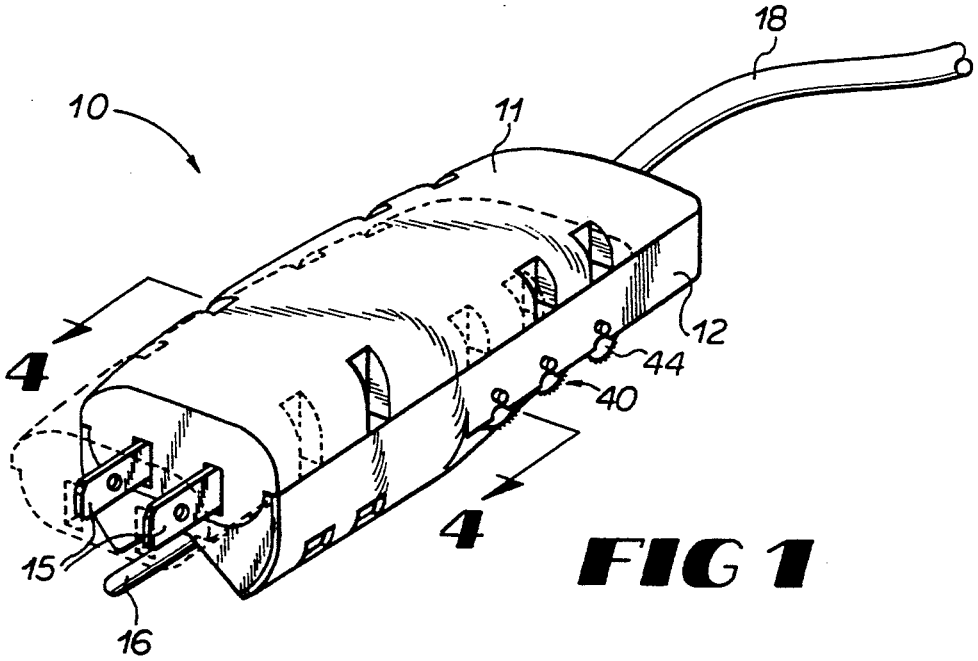
FIG. 1 is a perspective view of the plug locking device of the present invention in its preferred form, the device shown mounted to an electrical plug.
Figure 2:
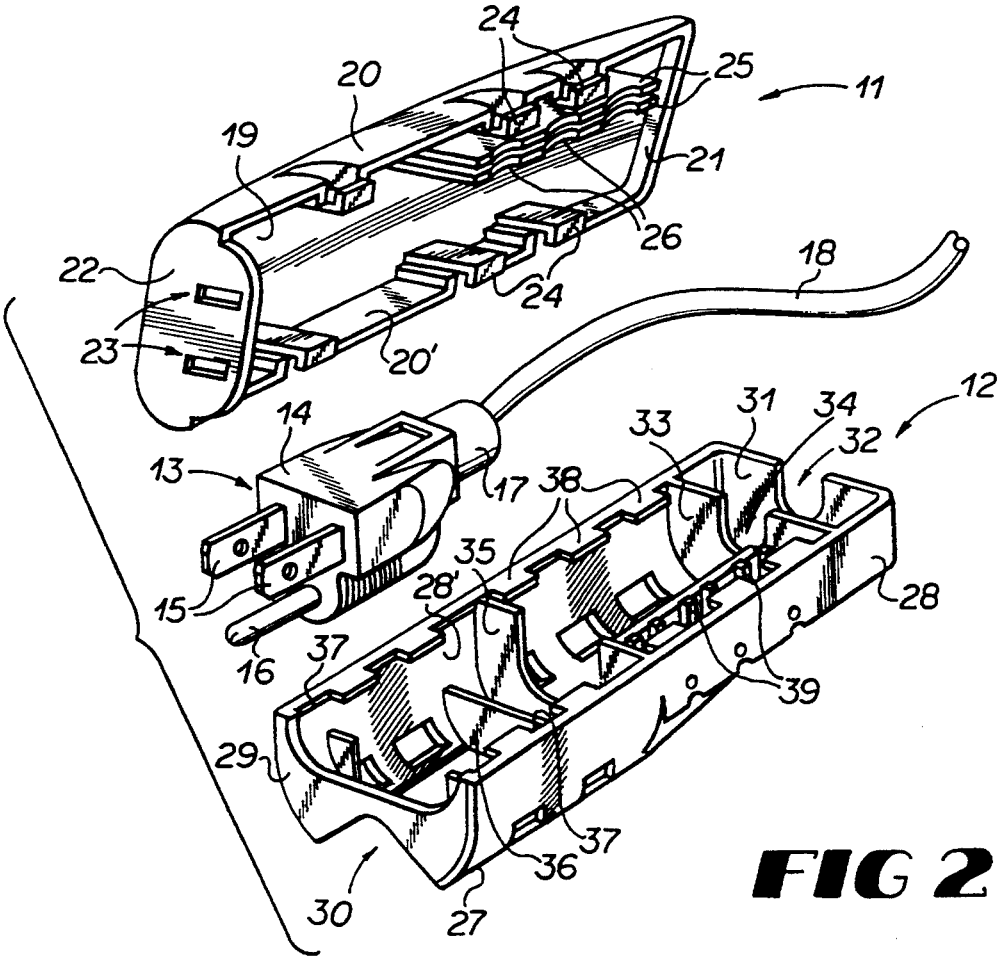
FIG. 2 is an exploded view, in perspective, of the plug locking device of FIG. 1.

Referring now in more detail to the drawings, in which like numerals indicate like parts throughout the several views, an electric plug locking device 10 is shown in FIG. 1 in an unlocked position with the locked position shown in phantom. The plug locking device 10 has an upper housing member 11 movably attached to a lower housing member 12 to form a housing which encases a conventional electrical plug 13. The plug 13, as best illustrated in FIG. 2, has a body 14, two terminals 15, a ground prong 16, a strain relief 17, and a cord 18 which connects the plug to an unshown appliance or other electrical apparatus. A conventional three-wheel locking system 40 is mounted along one side of the device.

With reference to FIG. 2, the upper housing member 11 is seen to comprise a top 19, two side walls 20 and 20', a rear wall 21, and a front wall 22 that has two parallel slots 23 for receiving the two terminals 15 of the electrical plug. Three pairs of outwardly facing, L-shaped snap hooks 24 constructed of resilient material are mounted along the side walls 20 and 20'. Each hook in each respective pair is transversely aligned with the other hook of the pair. The pairs of hooks are spaced apart such that a front pair is adjacent the front wall 22 and two rear pairs are grouped closer together adjacent the rear wall 21. Two parallel plates 25 having three indentations 26 are mounted adjacent the side wall 20. These plates 25 are part of the locking system 40 which is best detailed in FIGS. 3A and 3B.

The lower housing member 12 has a bottom 27, two side walls 28, 28', a front wall 29 having an opening 30 for receiving the ground prong 16 of the electrical plug 13, and a rear wall 31 having a U-shaped opening 32 for receiving the cord 18. An interior rear wall 33 also has a U-shaped opening 34 aligned with the opening 32 for receiving the cord 18. A U-shaped barrier wall 35 is mounted centrally within the interior of the lower housing member 12. A support wall 36 is mounted forwardly of the barrier wall 35 toward the front wall 29 to hold the strain relief 17 of the plug 13 in place between the barrier wall 35 and the front wall 29. A rim 37 extends coplanarly inwardly from the side walls 28 and 28' from which five pairs of shelves or ledges 38 extend. Each shelf of each respective pair is transversely aligned with the other shelf of the pair. Two front pairs of shelves are grouped together between the front wall 29 and the barrier wall 35. Three rear pairs of shelves are grouped together between the barrier wall 35 and the interior rear wall 33. Three U-shaped in-molded spring supports 39, which are part of the locking system 40, are located within the lower housing member 12 adjacent the side wall 28 and between the interior rear wall 33 and the barrier wall 35.

Figure 3A:
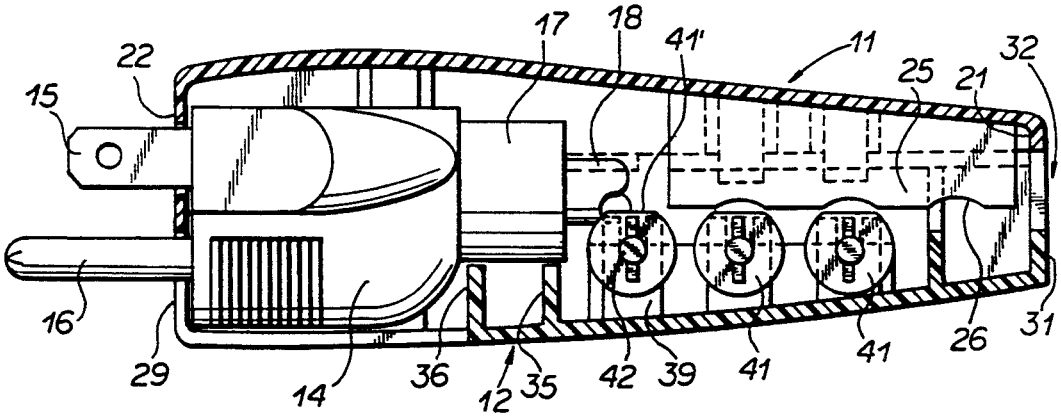

With reference to FIG. 3A, the locking system 40 has three wheels 41 each mounted at their center to rods 42 which are journaled in the valleys of the supports 39. The wheels 41 are disposed on the opposite side of the support 39 to the wheels 44. Each wheel 41 has a flat 41' in its annular perimeter. Exterior wheels 44, best shown in FIG. 1, mount at their center to the rods 42 for rotation of the rod and the wheel 41. The wheels 44 are disposed between the supports 39 and the side wall 28.

The wheels 44 display a symbol on their perimeter, such as a numerical digit, which is visible from the exterior of the lower housing member 12.

Figure 4:
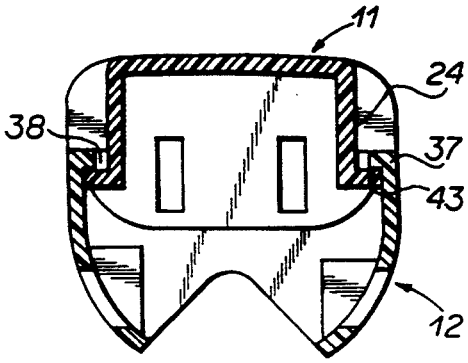
FIG. 4 is a transverse cross-sectional view of the plug locking device of FIG. 1 taken along plane 4—4 of FIG. 1.

FIG. 4 best illustrates the slidable attachment of the upper housing member 11 to the lower housing member 12. The three pairs of resilient snap hooks 24 of the upper housing member 11 interlock with the rim 37 of the lower housing member 12 along a bearing surface 43 which allows for the upper housing member 11 to slide between the unlocked and locked positions. When the snap hooks 24 are located between the shelves 38, the overlap that occurs is small. In this position, the resilient upper housing member 11 may be squeezed to disengage the snap hooks 24 thereby causing the upper and lower housing members to be detached.

Referring again to FIG. 3A, the plug 13 is seen mounted within the plug locking device 10 in an unlocked position with terminals 15 and ground prong 16 unsheathed and free to be inserted into an electrical socket. The terminals 15 extend through the slots 23 of the front wall 22 of the upper housing member 11 and the ground prong 16 extends through the opening 30 of the front wall 29 of the lower housing member 12. The body 14 of the plug 13 is snugly held within the plug locking device 10 between the front wall 22 of the upper housing member 11 and the front wall 29 of the lower housing member 12 and the support wall 36 which also supports the plug strain relief 17. The rear wall 21 of the upper housing member 11 and the rear wall 31 of the lower housing member 12 hold the cord 18 that extends through the opening 32. The wheels 41 of the locking system 40 in the unlocked position, shown in FIG. 3A, are set such that their flats 41' are parallel to the flat edge of the plates 25 and the annular perimeters of the wheels 41 are not in contact with the indentations 26 of the plates. Thus in this position the upper and lower housing members may be slid relative to each other.

Figure 3B:
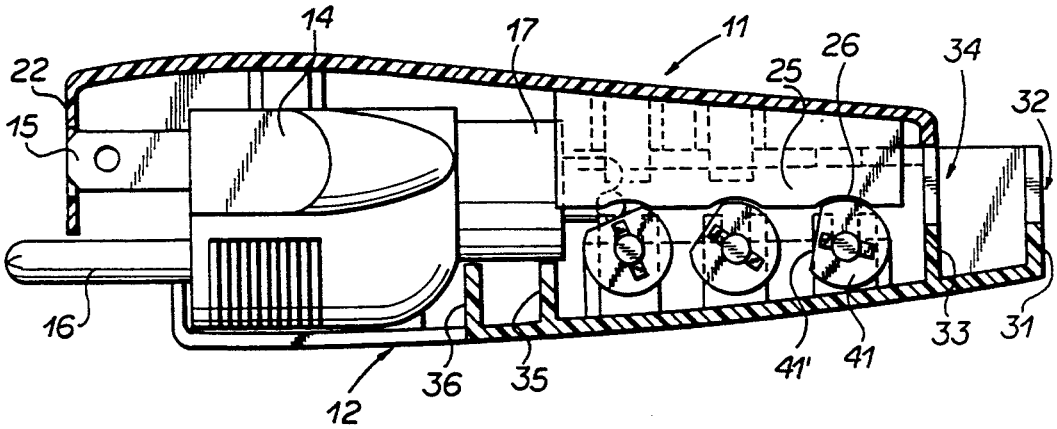
FIG. 3B is a side view, in cross-section, of the plug locking device of FIG. 1 shown in a locked position.

Conversely, as illustrated in FIG. 3B, the plug locking device 10 is shown in its locked position, the upper housing member 11 having been slid forwardly upon the lower housing member 12 so that its front wall 22 shields and hoods the terminals 15. This prevents terminals from being inserted into an electrical socket. The rear wall 21 of the upper housing member 11 and the interior rear wall 33 of the lower housing member 12 hold the cord 18 that extends through the opening 34. The locking system 40 in the locked position is set randomly such that the at least one flat 41' of a wheel 41 is not parallel to the flat edges of the plates 25. This causes the annular perimeter of that wheel 41 to be in mated contact with one of the indentations 26 of the plates 25, thereby preventing movement of the upper housing member 11 which engages the plug locking device 10. Unshown detent means also frictionally hold the wheels in their various angular positions.

It thus is seen that an electric plug locking device is now provided that affixes to a plug both in locked and unlocked positions. While this invention has been described in detail with particular reference to the preferred embodiment thereof, it should be understood that many modifications, additions and deletions may be made thereto without departure from the spirit and scope of the invention as set forth in the following claims.

What is claimed is:

1. An electric plug locking device having a lower housing member in which an electrical plug is seated, an upper housing member having an opening through which a plug terminal extends in an unshielding position, said upper housing member being mounted to said lower housing member to form a housing completely enclosing the plug and for relative movement of said upper housing member between a position sufficiently shielding the plug terminal as to prevent it from being inserted into an electrical socket and the position unshielding the plug terminal sufficient to permit it to be inserted into the socket without removing the plug from said housing, and lock means for locking said upper housing member in its shielding position.

2. The electric plug locking device of claim 1 wherein the lower housing member further comprises a front wall having an opening through which a ground prong may project.

3. The electric plug locking device of claim 1 wherein the upper housing member further comprises two sides each having snap hooks extending therefrom and the lower housing member further comprises two sides each having a ledge extending therefrom, whereby the snap hooks interlock with the ledges for attachment and sliding movement.

4. The electric plug locking device of claim 1 wherein the lock means comprises rotatable wheels, each wheel having an annular perimeter with a flat portion, and a plate having a flat surface with indentations, each indentation associated with one of the wheels, the indentations receiving the annular perimeter of the respective wheels and means for rotating the rotatable wheels, whereby the lock means is disengaged upon rotating the wheels such that the annular perimeters are free of the respective indentations.

5. An electric plug locking device, comprising:

a lower housing member and an upper housing member having an opening, said lower housing member and said upper housing member forming a housing enclosing an electrical plug having a terminal;

the upper housing member slidably attached to the lower housing member defining an interior area for enclosing the electrical plug, the upper housing member slidably movable from a first position exposing the terminal through the opening to a second position covering the terminal; and lock means for locking the upper housing member in the second position, whereby the terminal exposed with the upper housing member in the first position so that it can be connected to a source of electricity without removing the plug from the housing.

6. The electric plug locking device of claim 5 wherein the upper housing member further comprises two sides each having snap hooks extending therefrom and the lower housing member further comprises two sides each having a ledge extending therefrom, whereby the snap hooks interlock with the ledges for attachment and sliding movement.

7. The electric plug locking device of claim 5 wherein the lock means comprises rotatable wheels, each wheel having an annular perimeter with a flat portion, and a plate having a flat surface with indentations, each indentation associated with one of the wheels, the indentations receiving the annular perimeter of the respective wheels and means for rotating the rotatable wheels, whereby the lock means is disengaged upon rotating the wheels such that the annular perimeters are free of the respective indentations.

8. The electric plug locking device of claim 5 wherein the lower housing member further comprises an interior support wall that cooperates with a front wall for grippingly holding the plug in the interior area.

9. An electric plug locking device having a lower housing member and a upper housing member forming a housing to enclose an electrical plug, said lower housing member, in which the electric plug may be seated, having two sides each having a ledge extending therefrom, said upper housing member having an opening through which a plug terminal may extend and having two sides each having snap hooks extending therefrom, said upper housing member being slidably mounted to said lower housing member by interlocking the snap hooks with the ledges for relative movement of the upper housing member between a position sufficiently shielding the plug terminal as to prevent it from being inserted into an electrical socket and a position unshielding the plug terminal sufficient to permit it to be inserted into the electrical socket, and lock means for locking said upper housing member in its shielding position.

10. An electric plug locking device having a lower housing member in which an electrical plug may be seated, an upper housing member having an opening through which a plug terminal may extend, said upper housing member being mounted to said lower housing member to form a housing to completely enclose the plug and for relative movement of said upper housing member between a position sufficiently shielding the plug terminal as to prevent it from being inserted into an electrical socket and a position unshielding the plug terminal sufficient to permit it to be inserted into the electrical socket, lock means for locking said upper housing member in its shielding position comprising rotatable wheels, each wheel having an annular perimeter with a flat portion, a plate having a flat surface with indentations, each indentation associated with one of the wheels, the indentations receiving the annular perimeter of the respective wheels, and means for rotating the rotatable wheels, whereby the lock means is disengaged upon rotating the wheels such that the annular perimeters are free of the respective indentations.

11. An electric plug locking device, comprising:

a lower housing member and an upper housing member forming a housing to enclose an electrical plug having a terminal;

the lower housing member comprising two sides each having a ledge extending therefrom;

the upper housing member comprising two sides each having snap hooks extending therefrom;

the upper housing member slidably attached to the lower housing member by interlocking the snap hooks with the ledges, the upper and lower housing members defining an interior area for enclosing the electrical plug, the upper housing member slidably movable from a first position exposing the terminal to a second position covering the terminal; and lock means for locking the upper housing member in the second position;

whereby the terminal, upon being exposed with the upper housing member in the first position, is connectable to a source of electricity.

12. An electric plug locking device, comprising:

a lower housing member and an upper housing member forming a housing to enclose an electrical plug having terminal;

the upper housing member slidably attached to the lower housing member defining an interior area for enclosing the electrical plug, the upper housing member slidably movable from a first position exposing the terminal to a second position covering the terminal; and a lock means for locking the upper housing member in the second position comprising rotatable wheels, each wheel having an annular perimeter with a flat portion, a plate having a flat surface with indentations, each indentation associated with one of the wheels, the indentations receiving the annular perimeter of the respective wheels, and means for rotating the rotatable wheels, whereby the lock means is disengaged upon rotating the wheels such that the annular perimeters are free of the respective indentations.

* * * * *